US005461773A

United States Patent [19]

Kawaguchi

[11] Patent Number: 5,461,773

[45] Date of Patent: Oct. 31, 1995

[54] METHOD OF MANUFACTURING COILS FOR USE IN CHARGED PARTICLE DEFLECTING ELECTROMAGNET

[75] Inventor: Takeo Kawaguchi, Kobe, Japan

[73] Assignee: Mitsubishi Denki Kabushiki Kaisha, Tokyo, Japan

[21] Appl. No.: 133,340

[22] Filed: Oct. 8, 1993

Related U.S. Application Data

[62] Division of Ser. No. 751,054, Aug. 28, 1991, Pat. No. 5,278,533.

[30] Foreign Application Priority Data

Aug. 31, 1990 [JP] Japan ..... 2-228020
Aug. 19, 1991 [JP] Japan ..... 3-206777

[51] Int. Cl.[6] ..... H01F 41/06

[52] U.S. Cl. ..... 29/605; 335/213

[58] Field of Search ..... 29/605; 335/210, 335/213, 216

[56] References Cited

U.S. PATENT DOCUMENTS 4,902,993 2/1990 Krevet .
5,111,173 5/1992 Matsuda et al. .
5,117,194 5/1992 Nakanishi et al. .
5,117,212 5/1992 Yamamoto et al. .

FOREIGN PATENT DOCUMENTS 64-2300 1/1989 Japan .

OTHER PUBLICATIONS

"IEEE Transactions on Magnetics"; vol. MAG-21, No. 6, pp. 2457–2460; Nov. 1985.

*Primary Examiner*—Carl E. Hall
*Attorney, Agent, or Firm*—Leydig, Voit & Mayer

[57] ABSTRACT

A coil is provided for use in a deflecting electromagnet in which two coil end portions are bent as well as a method of manufacturing the same. In the coil, a plurality of coil units in each of which two coil end portions 3*c* are bent such that they oppose each other are laid on top of one another, and the individual coil units are electrically connected to each other. Alternatively, two-layer coil units in each of which the two ends of the conducting wire are located on the outer side of the outer diameter portion of the coil unit are laid on top of one another, so that all the connecting portions of the conducting wires between the individual two-layer coil units can be located on the outer side of the outer diameter portions. Alternatively, the connecting portions of the conducting wires between the individual coil units are extending such that they are separated from the coil unit.

5 Claims, 11 Drawing Sheets

METHOD OF MANUFACTURING COILS FOR USE IN CHARGED PARTICLE DEFLECTING ELECTROMAGNET

This application is a divisional of application Ser. No. 07/751,054, filed Aug. 28, 1991 now U.S. Pat. No. 5,278, 533.

BACKGROUND OF THE INVENTION

1. Field of the Invention

The present invention relates to a coil for use in a charged particle deflecting electromagnet used in, for example, a synchrotron radiation generating apparatus, and a method of manufacturing such a coil.

2. Description of the Related Art

FIG. 12 is a schematic plan view of a charged particle generating apparatus disclosed in, for example, Japanese Patent Laid-Open No. 2300/1989. In the apparatus shown in FIG. 12, charged particles incident through an incident portion (not shown) and an acceleration portion (not shown) are deflected by two superconducting deflecting electromagnets 30 disposed in opposed relation and thereby move on an elliptical path 20.

FIG. 13A is a plan view of one example of a superconducting coil of the superconducting deflecting electromagnet 30 shown in FIG. 12, and FIG. 13B is a section taken along a line XIIIB—XIIIB of FIG. 13A.

Two superconducting coils 1, each of which is formed by winding a superconducting wire 2, are disposed in opposed relation at the upper and lower portion of the elliptical path 20. Each of the superconducting coils 1 is curved at a predetermined radius of curvature. The superconducting coil 1 has an inner diameter portion 1*a* located on the inner diameter side of the path 20, an outer diameter portion 1*b* located on the outer diameter side of the path 20 and curved in the same manner as the inner diameter portion 1*a*, and coil end portions 1*c* located between the inner and outer diameter portions 1*a* and 1*b*.

The thus-arranged superconducting coil 1 exhibits superconductivity when it is cooled to a temperature of, for example, −268° C. Conduction of a current in the superconducting coil 1 exhibiting superconductivity produces a magnetic field having a high magnetic flux density of several teslas. The path 20 of the charged particles is bent in the manner shown in FIG. 12 by this generated magnetic field.

FIGS. 14A to 14C show another example of the conventional superconducting coil 1. This superconducting coil 1 has been described from page 2457 to page 2460 of IEEE TRANSACTIONS ON MAGNETICS, Vol. 1, Mag-24, No. 6, published in November 1985. FIG. 14A is a perspective view of the superconducting coil 1, FIG. 14B is a sectional view of the outer diameter portion 1*b*, taken along a line XIVB– XIVB of FIG. 14A, and FIG. 14C is a sectional view of the coil end portion 1*c*, taken along a line XIVC—XIVC of FIG. 14A.

In the superconducting coil 1 shown in FIG. 14, each of the coil end portions 1*c* is bent at a predetermined angle θ in a direction in which it is separated from the path 20 so as to allow the path 20 to be less affected by the magnetic field generated by the coil end portions 1*c*. This superconducting coil 1 is called the banana coil with bending ends. The superconducting coil 1 is disposed at the upper and lower portions of the path 20, as in the case of the coil shown in FIGS. 13A and 13B.

As shown in FIG. 14B, at the outer diameter portion 1*b* of the coil 1, N layers of the superconducting wire 2, from a first layer L1 to an Nth layer LN, are laid on top of another in the horizontal direction with the first layer L1 being disposed on the innermost side. At the inner diameter portion 1*a*, layers of superconducting wire 2 are formed similarly with the exception that the first layer L1 is disposed on the right end. At each of the coil end portions 1*c*, the layers of the superconducting wire 2 are laid on top of another in the vertical direction with the first layer L1 being disposed on the lowermost side.

A conventional method of manufacturing the superconducting coils 1 shown in FIG. 14A will be described below with reference to FIG. 15.

First, the first layer L1 of the coil 1 is formed by winding the superconducting wire 2 a predetermined number of times in a left-handed fashion (starting from the outer diameter portion 1*b*, the coil end portion 1*c*, the inner diameter portion 1*a* and then the coil end portion 1*c*) and outwardly (starting from the uppermost portion as viewed in FIG. 14B). Subsequently, the second layer L2 is formed by winding the superconducting wire 2 along the first layer L1 in a left-handed fashion and inwardly. Thereafter, the superconducting wire 2 is wound similarly along the previous layer until the number of layers reaches the predetermined number N to manufacture the superconducting coil 1.

In the conventional superconducting coil of the above-described type, since the superconducting wire 2 must be wound in a curved fashion and three-dimensionally, a complicated winding device (not shown) is required, increasing production cost and hence the price of the coil. Furthermore, the superconducting wire 2 is sequentially wound outwardly to form the odd layers and inwardly to form the even layers. At that time, particularly when the even layers are formed, a gap may be generated between the adjacent superconducting wires 2 at the portion indicated by an arrow R in FIG. 15. With the gap between the adjacent superconducting wires 2, when a current is supplied to the superconducting coil 1, the wire 2 may be moved due to the electromagnetic force, generating quenching which leads to breakage of the superconducting state. SUMMARY OF THE INVENTION In view of the aforementioned problems of the conventional coils, an object of the present invention is to provide a method of manufacturing a coil for use in a charged particle deflecting electromagnet which can be manufactured without using a complicated winding device, which exhibits excellent characteristics and which is bent at two coil end portions.

To achieve the above object, the present invention provides a coil for use in a charged particle deflecting electromagnet in which a plurality of flat coil units are laid on top of one another, each of the flat coil units having two coil end portions which are bent such that they oppose each other, and in which the individual coil units are electrically connected with each other.

The present invention provides a method of manufacturing coils for use in charged particle deflecting electromagnets which comprises the steps of forming a plurality of flat coils, each of the flat coils being formed by winding a conducting wire a plurality of times, forming the coil units by bending the coil end portions of each of the flat coils such that they oppose each other, laying the coil units on top of another, and electrically connecting the coil units with each other.

In a preferred form, the coil manufacturing method comprises the steps of forming a plurality of two-layer flat coils by winding a conducting wire having a length corresponding to two layers from an intermediate portion thereof in two directions such that two ends of the conducting wire can be located at the outer diameter portion, forming the two-layer coil units by bending the two coil end portions of each of the two-layer flat coils such that they oppose each other, laying a predetermined number of two-layer coil units on top of another, and electrically connecting the two-layer coil units with each other.

In the coil for use in a deflecting electromagnet according to the present invention, since a flat coil formed by winding conducting wire outwardly is used, a gap between the conducting wires is small, and a shift of the conducting wires can be prevented.

In the coil formed by laying the two-layer coil units on top of another, since the number of connecting portions can be reduced and all the connecting portions are located on the outer side of the outer diameter portion, the influence of the magnetic field generated by the coil on the connecting portions can be alleviated.

When the connecting portions are extended from the coil, the influence of the magnetic field can be further alleviated.

In the method of manufacturing coils for use in deflecting electromagnets, since the coil unit is formed by bending the two coil end portions of a flat coil, a complicating winding device it not necessary.

A two-layer coil unit in which the connecting portions are located on the outer side of the outer diameter portion can be formed by winding a conducting wire outwardly from the intermediate portion thereof in two directions. Since winding of the conducting wire inwardly is not necessary, a gap between the conducting wires can be reduced. This prevents a shift of the conducting wires.

Other objects of the present invention will appear in the following description and appended claims, reference being had to the accompanying drawings forming a part of this specification wherein like reference numerals designate corresponding parts in the views.

DETAILED DESCRIPTION OF THE PREFERRED EMBODIMENTS

Embodiments of the present invention will be described below with reference to the accompanying drawings. First, a method of manufacturing superconducting coils according to a first embodiment of the present invention will be described with reference to FIGS. 1A to 1C and 2.

Figure 1A:
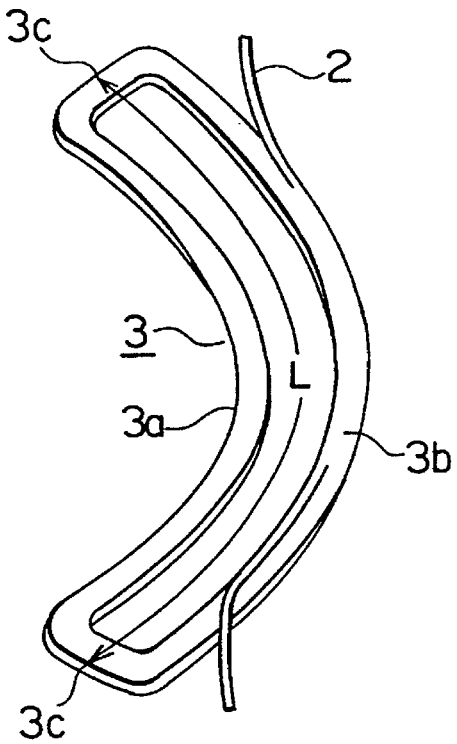
FIGS. 1A to 1C are perspective views sequentially illustrating the manufacturing processes of a method of manufacturing a superconducting coil according to a first embodiment of the present invention.
Figure 12:
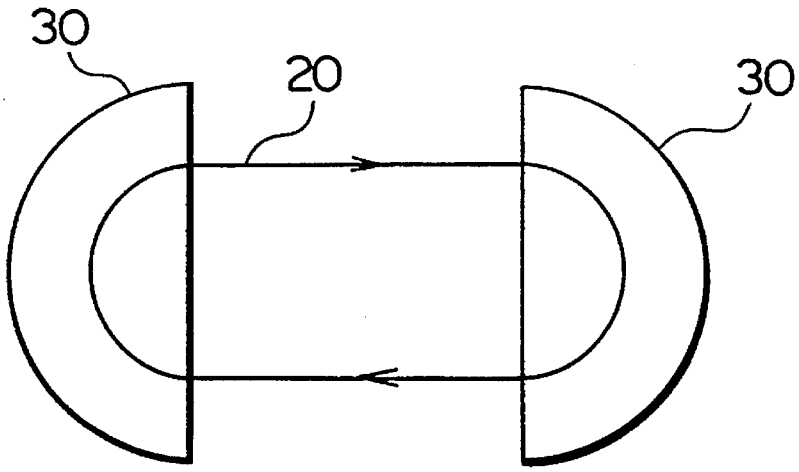
FIG. 12 is a plan view showing a schematic configuration of a known charged particle apparatus.
Figure 13A:
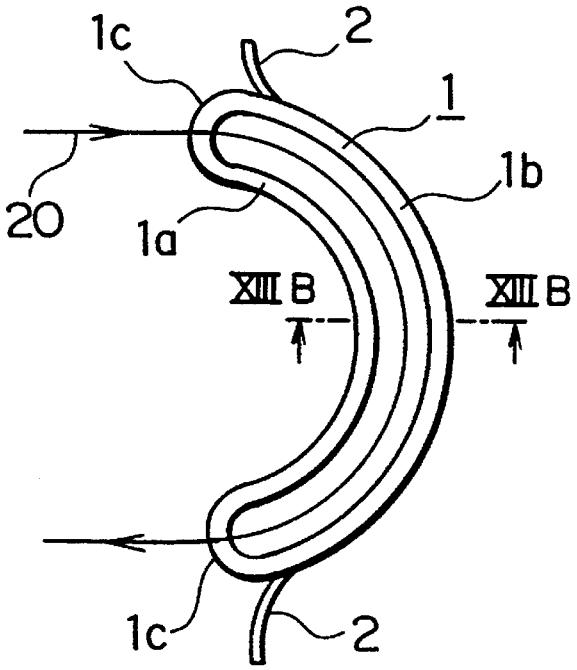
FIG. 13A is a plan view showing one example of a superconducting coil of a superconducting deflecting electromagnet of FIG. 12.
Figure 13B:
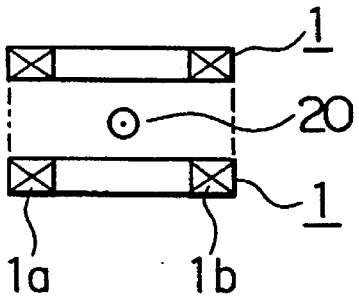
FIG. 13B is a section taken along a line XIIIB—XIIIB of FIG. 13A.
Figure 14A:
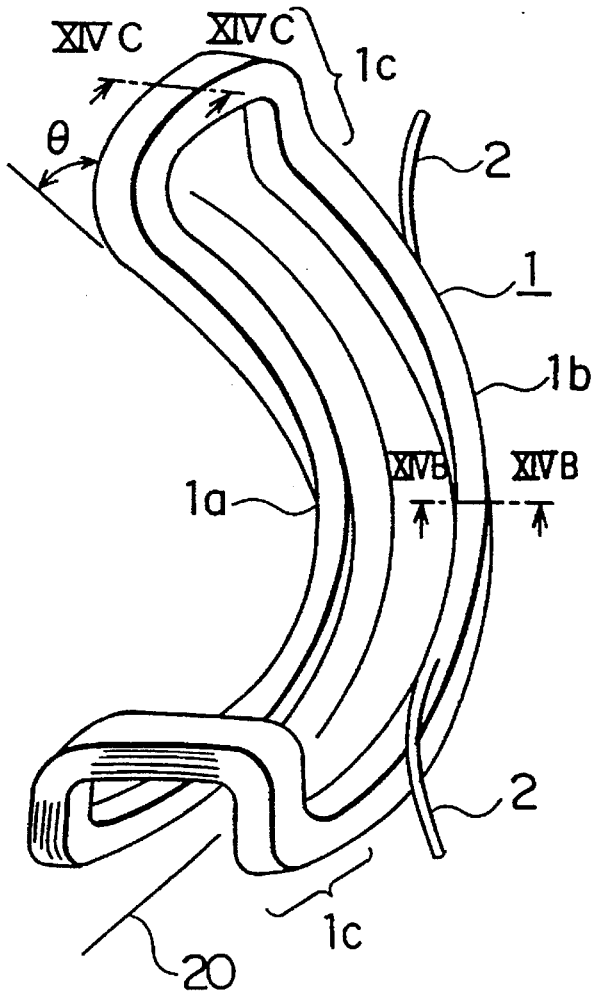
FIG. 14A is a perspective view of another example of a conventional superconducting coil.
Figure 14B:
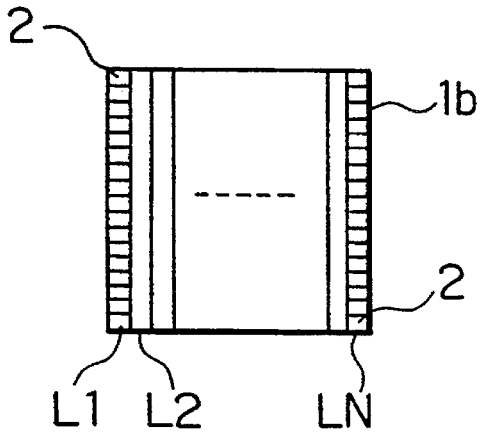
FIG. 14B is a cross-sectional view taken along a line XIVB—XIVB of FIG. 14A.
Figure 14C:
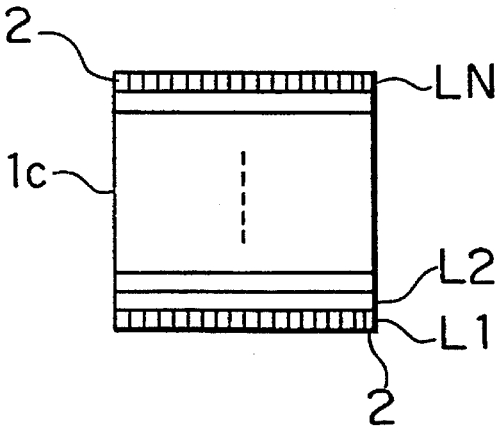
FIG. 14C is a section taken along aline XIVC—XIVC of FIG. 14A.
Figure 15:
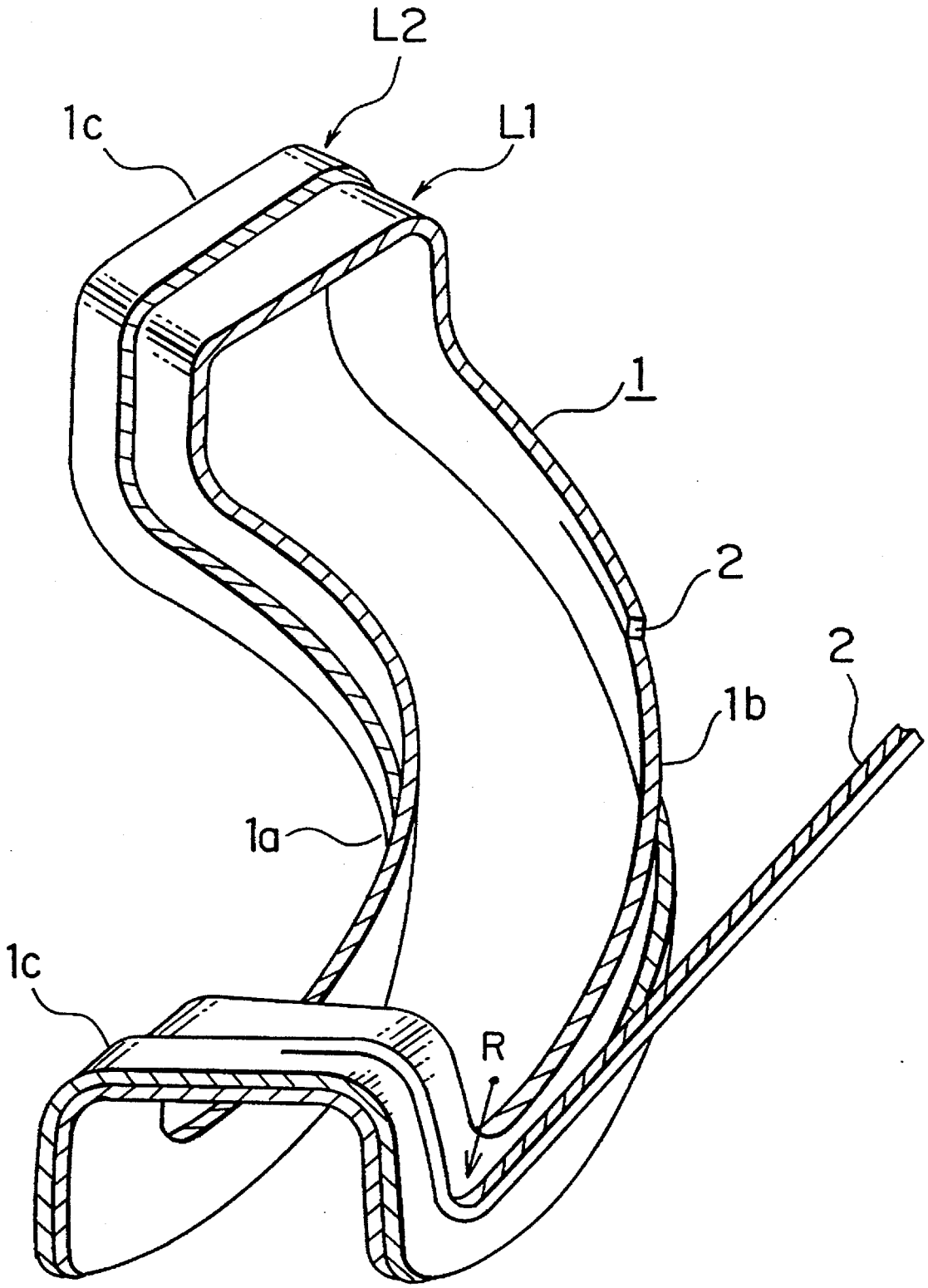
FIG. 15 illustrates a conventional method of manufacturing a superconducting coil.

First, a first layer of flat coil 3 shown in FIG. 1A is formed by winding the superconducting wire 2 in a left-handed fashion and outwardly a predetermined number of times (step S1). The formed flat coil 3 includes an inner diameter portion 3*a* which is disposed on the inner diameter side of the charged particle path 20 (see FIG. 12), an outer diameter portion 3*b* disposed on the outer diameter side of the path, and coil end portions 3*c* located between the inner and outer diameter portions 3*a* and 3*b*. In this embodiment, a plurality of flat coils 3 are laid on top of another to form a superconducting coil. Since the overlaid flat coils must be connected in series in subsequent process, the right- and left-handed coils are laid alternately. In this embodiment, the odd layers are constituted by the left-handed coils, whereas the right-handed coils form the even layers.

Next, a thermoset varnish (not shown), serving as an adhesive for fixing the superconducting wires 2 to each other, is coated on the formed flat coil 3 (step S2). Thereafter, the flat coil 3 is pressed by a press (not shown) to shape it, and then the varnish is heated and thereby set to fixedly adhere the superconducting wires 2 (step S3).

Figure 1B:
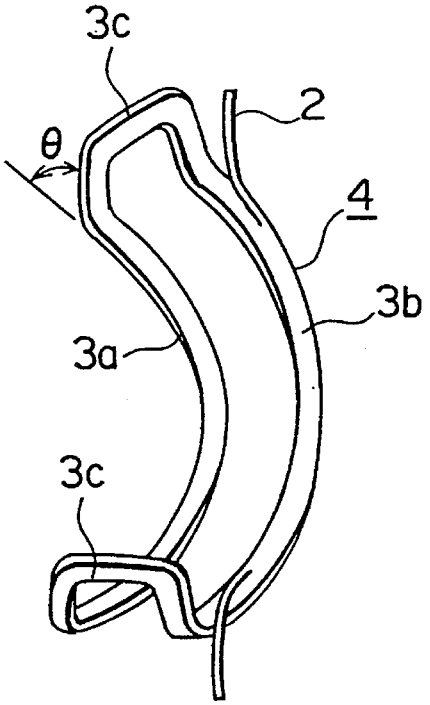

Subsequently, the two coil end portions 3*c* are bent by a bending machine (not shown) relative to the plane containing the inner and outer diameter portions 3*a* and 3*b*, as shown in FIG. 1B. Consequently, the coil end portions 3*c* are bent in the direction opposite to the path 20 by a predetermined angle θ such that they oppose each other (step S4), by means of which the coil unit (pancake unit) 4, composing the first layer, is formed (step S5).

Next, the process returns to step S1 and the second layer coil unit is formed. Since the second layer is the even layer, the second layer flat coil 3 is formed by winding the superconducting wire 2 in a right-handed fashion and outwardly a predetermined number of times (step S1). The overview of second layer flat coil 3 is the same as that of the flat coil 3 shown in FIG. 1A except for the inner end of the superconducting wire 2 is directed in an upward direction while the outer end thereof extends in a downward direction. Also, the second layer flat coil 3 has a shorter longitudinal length L than the first layer coil. This allows the height of the raised coil end portions 3*c* of the coil units 4 laid on top of another to be made the same. That is, the flat coil laid on an inner or upper side has a shorter longitudinal length L than the flat coil laid immediately on the outer or lower side of this flat coil.

Next, a varnish (not shown) is coated on the flat coil 3 wound in the same manner as the first layer (step S2), and then the flat coil is pressed by a press and heated to fix the superconducting wires 2 to each other (step S3). Subsequently, the two coil end portions 3*c* of the flat coil 3 are bent such that they can be exactly registered with the coil end portions of the first layer flat coil when the flat coil 3 is laid on top of the first layer flat coil (step S4), by which the second layer coil unit 4 is formed (step S5).

The process from step S1 to step S5 is repeated to form a predetermined number of coil units (which constitute, for example, N layers) (step S6).

Figure 3:
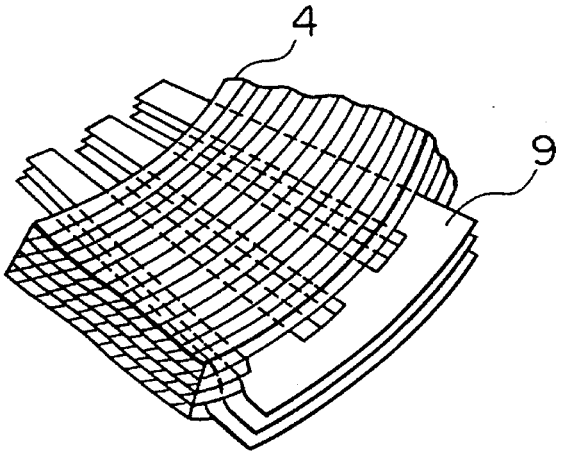
FIG. 3 is a perspective view showing a state in which a comb-shaped adhesive sheet is interposed between adjacent coil units in the individual coil units which are laid.

When the coil units composing the N layers are manufactured, the coil units 4 are sequentially laid on top of another in a predetermined order to form a coil portion. At that time, comb-shaped thermoset adhesive sheets 9 are interposed between the adjacent coil units 4, as shown in FIG. 3 (step S7). The comb-shaped adhesive sheets 9 are provided to bond the coil units with each other and to allow a coolant to flow into the portion (gap) between the coil units where the adhesive sheets do not exist and thereby enhance the cooling efficiency of the coil units. The gap portion where the adhesive sheets do not exist extends in the direction transverse to the superconducting wires 2, and hence cannot be the cause of the shift of the superconducting wires 2. The unnecessary peripheral portions of the adhesive sheets 9 are cut off later.

Figure 1C:
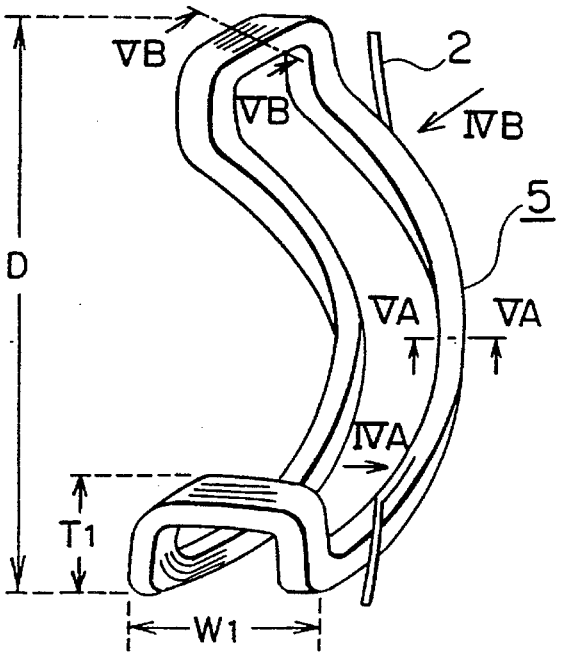
Figure 2:
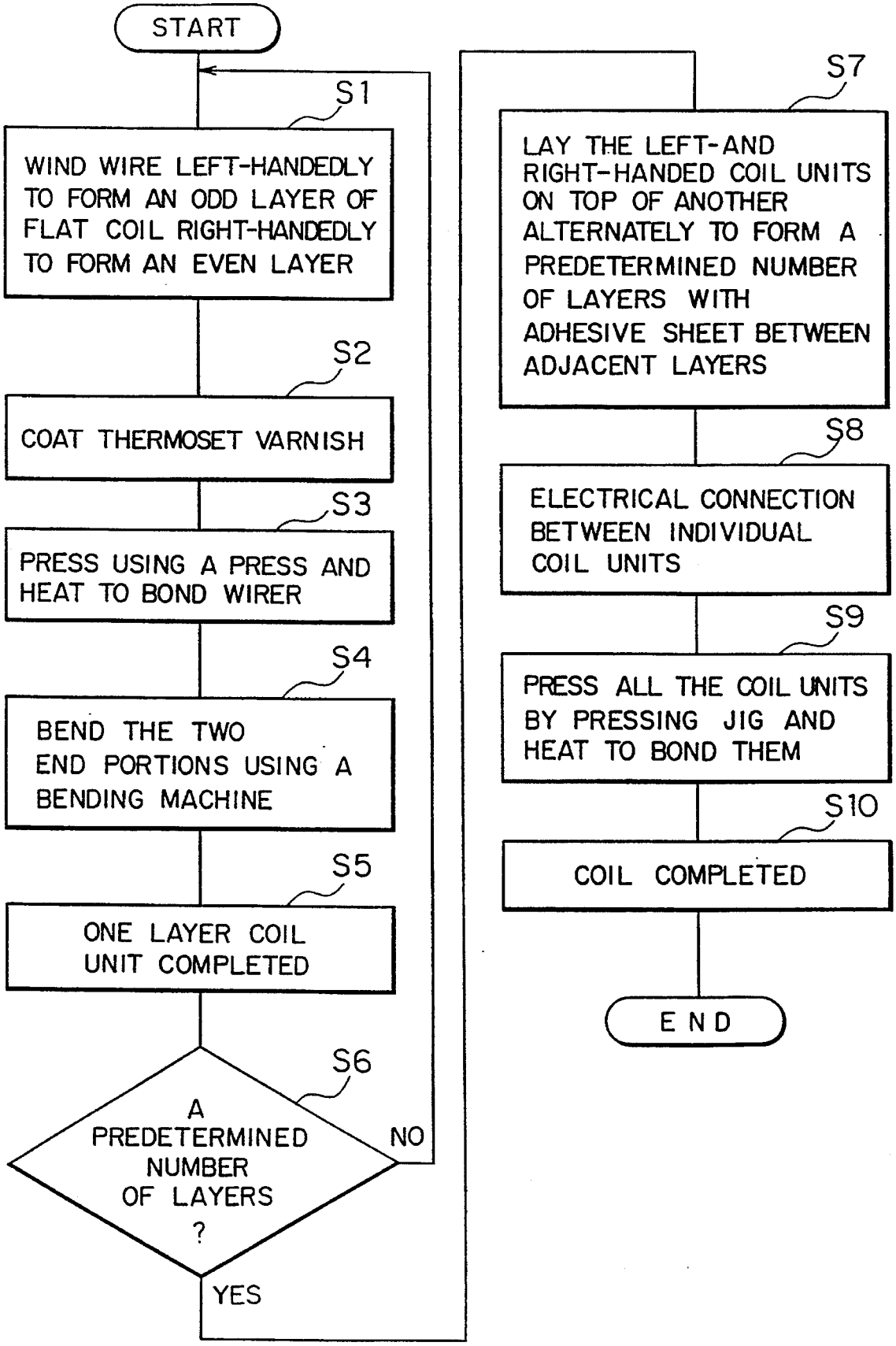
FIG. 2 is a flowchart of the embodiment shown in FIGS. 1A to 1C.
Figure 4A:
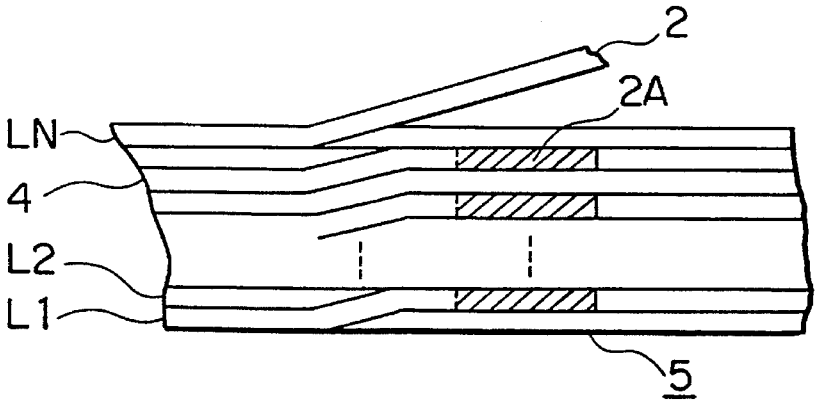
FIG. 4A is a side elevational view of connecting portions as viewed from a direction indicated by an arrow IVA of FIG. 1C.
Figure 4B:
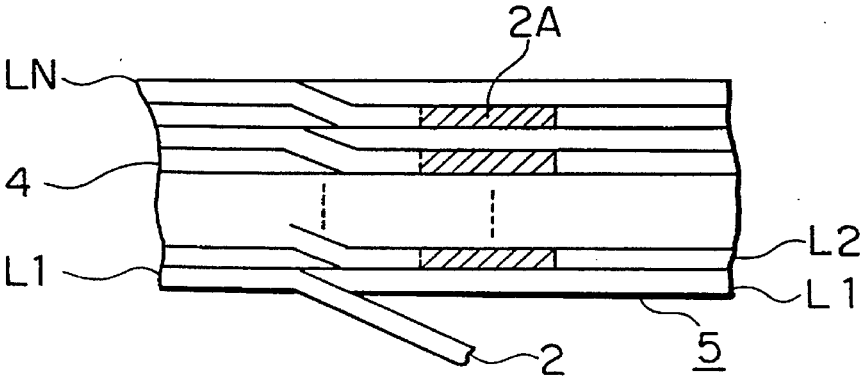
FIG. 4B is a side elevational view of the connecting portions as viewed from a direction indicated by an arrow IVB of FIG. 1C.

Next, the inner ends of the superconducting wires 2 of the adjacent coil units 4 in the individual coil units 4 are electrically connected to each other while the outer ends of the superconducting wires 2 of the adjacent coil units 4 in the individual coil units 4 are electrically connected to each other to connect the N coil units 4 in series (step S8). FIG. 4A shows the inner connecting portion of the outer diameter portion 3*b* as viewed from the direction indicated by an arrow IVA of a superconducting coil 5 shown in FIG. 1C, and FIG. 4B shows the outer connection portion of the outer diameter portions 3*b* as viewed from the direction indicated by an arrow IVB of FIG. 1C. In this embodiment, in the first layer L1 to Nth layer LN, a connecting portion 2A of the superconducting wires 2 exists on the inner and outer sides of the outer diameter portions of the coil units 4 which constitute the even layers. At each of the connecting portions 2A, the ends of the superconducting wires 2 are connected to each other by pressing, soldering or melting. In FIGS. 4A and 4B, the adhesive sheets 9 (see FIG. 3) interposed between the adjacent coil units are not shown.

Thereafter, the laid N coil units 4 are pressed by a pressing jig (not shown) and thereby shaped, and then heated to form a superconducting coil 5 shown in FIG. 1C (steps S9 and S10).

Figure 5A:
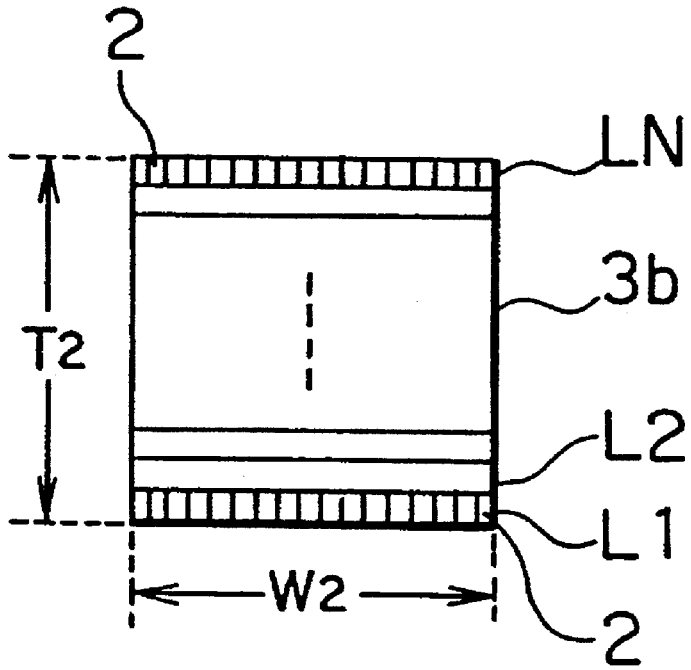
FIG. 5A is a section of an outer diameter portion taken along a line VA—VA of FIG. 1C.
Figure 5B:
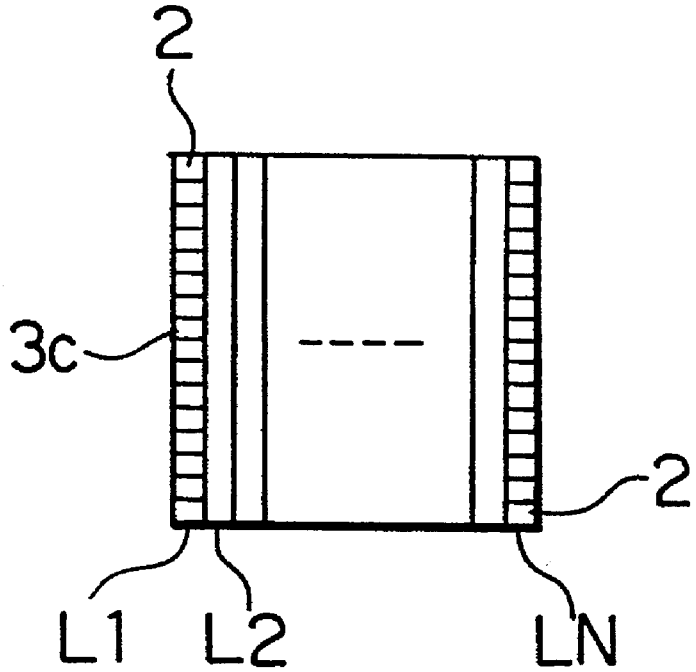
FIG. 5B is a section of a coil end portion taken along a line VB—VB of FIG. 1C.

FIG. 5A is a section taken along a line VA—VA of FIG. 1C, and FIG. 5B is a sectional view taken along a line VB—VB of FIG. 1C. This superconducting coil 5 according to the present invention differs from the conventional superconducting wire in that at the outer diameter portion thereof the superconducting wire layers are laid on top of another in the vertical direction with the first layer L1 being disposed at the lowermost position. At the inner diameter portion, the layers are laid similarly. At the coil end portion, the layers are laid on top of another inwardly in the horizontal direction with the first layer L1 being disposed at the outermost position. In FIGS. 5A and 5B, the adhesive sheets 9 (see FIG. 3) interposed between the adjacent coil units are omitted.

In the superconducting coil 5 shown in FIG. 1C, a diameter D is about 2 m, a width W1 is about 60 cm, and a height of the coil end portion T1 is about 45 cm. In the superconducting coil shown in FIG. 5A, both of a height of the section T2 and a width W2 thereof are about 13 cm.

In the first embodiment of the superconducting coil manufacturing method, since winding of the superconducting wire 2 is conducted only when the flat coil 3 is formed, a complicating winding device is not required. Therefore, production cost can be reduced and the price of the superconducting coil 5 can thus be reduced.

Furthermore, in the above-described manufacturing method, the coil units 4 are laid on top of another after the bending. Therefore, bending of the coil end portions is conducted on the single flat coil 3, and a bending machine of a small size is enough.

Furthermore, since after the flat coil 3 is formed by closely winding the superconducting wire 2, the coil end portions 3*c* are raised and a gap is not generated between the superconducting wires 2. Consequently, generation of quenching due to the shift of the superconducting wire 2 is minimized. As a result, the superconducting characteristics of the superconducting coil 5 can be stabilized, and a highly reliably coil can be obtained.

Figure 6:
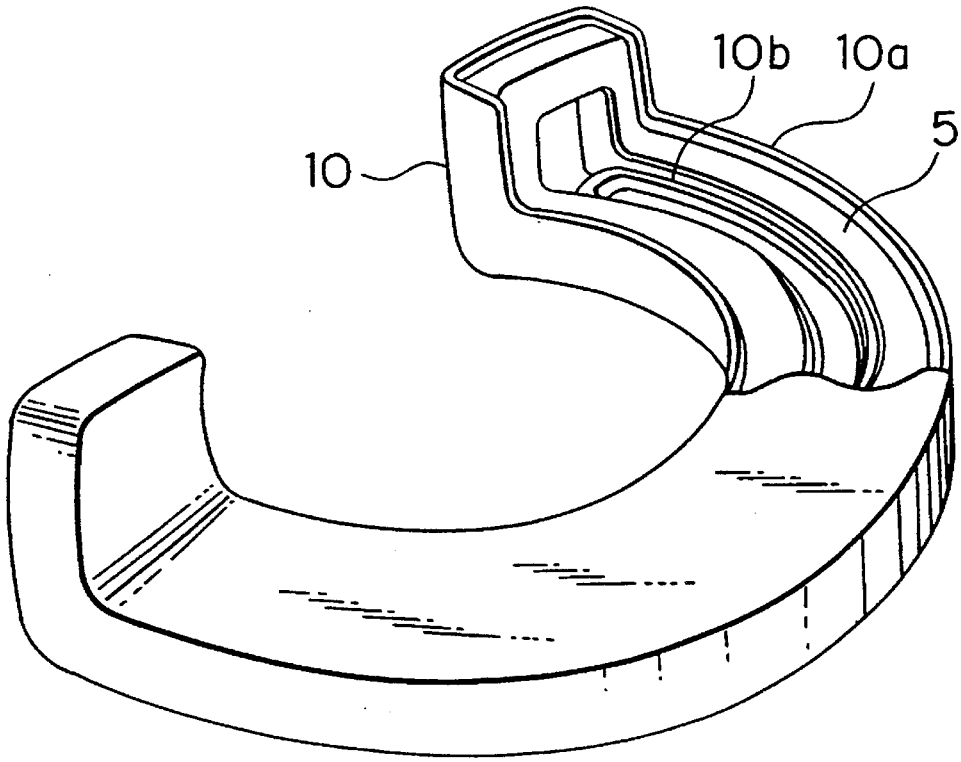
FIG. 6 is a perspective view, with part broken away, showing a state in which a superconducting wire is housed in a coil container.

FIG. 6 is a perspective view, with part broken away, of a superconducting coil according to the present invention accommodated in a coil container. The superconducting coil 5 is housed in a coil container 10 made of stainless steel and having a shape corresponding to that of the superconducting coil 5. Within the container 10, the superconducting coil 5 is fixed between an outer wall 10*a* and an inner frame 10*b* by means of a fixing means (not shown) so that it cannot move due to the electromagnetic force by the magnetic field generated by the coil 5 itself. The coil container 10 is charged with a coolant (not shown), such as liquid helium, and the interior of the coil container 10 is thereby maintained to a very low temperature to maintain the superconducting coil 5 in a superconducting state. On the inner side of the inner frame 10*b* is disposed a correction coil for correcting the generated magnetic field or an auxiliary coil for reinforcing the intensity of magnetic field, illustration and description thereof being omitted.

Figure 7A:
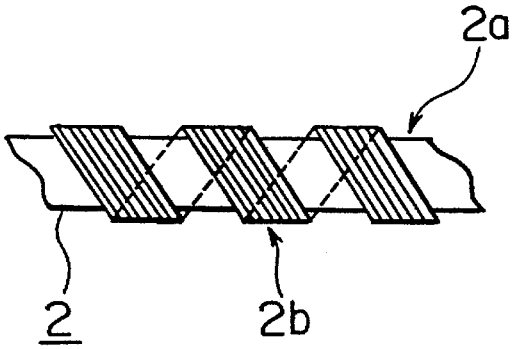
FIGS. 7A and 7B are respectively plan and cross-sectional views of the superconducting wire used in this invention.
Figure 7B:
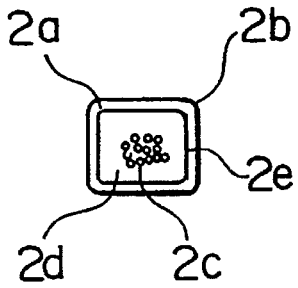

FIGS. 7A and 7B are respectively plan and cross-sectional views of the superconducting wire 2 used to form the superconducting coil 5 according to the present invention.

The superconducting wire 2 includes a rectangular wire 2*a*, and a bundle of filaments 2*b* wound around the rectangular wire 2*a* in a helical (spiral) fashion so that a space exists between the windings, as shown in FIG. 7A. The length of the two sides of the rectangular wire 2*a* is from 2 to 3 mm. The rectangular wire 2*a* includes a bundle of superconducting filaments 2*c* made of niobium titanium (NbTi), a copper covering 2*d* which covers the bundle of thin wires 2*c*, and an insulating layer 2*e* made of formal to cover the surface of the copper covering 2*d*. The filaments 2*b* are made of polyamide, glass or nylon. The diameter of a single filament is from 10 to 50 μm. 50 to 100 filaments 2*b* are bundled, and that bundle is wound on the surface of the rectangular wire 2*a* helically so that a space exists between the adjacent windings.

When the superconducting coil 5 is formed by winding the superconducting wires 2, the varnish is coated on the superconducting wires 2 to fix them to each other. At that time, the varnish attaches to the filaments 2*b* also. In the conventional superconducting wire, a tape having a small width is wound on the conducting wire. However, it is very difficult to helically wind the tape on the conducting wire having a small cross-sectional area. Accordingly, a bundle of filaments 2*b* is used in this invention in place of the tape. The bundle of filaments 2*b* are wound so that a space exists between the adjacent windings because such a winding allows the coolant to make direct contact with the gap portion of the rectangular wire 2*a* where the filaments 2*b* do not exist and thereby enhances the cooling effect.

In the first embodiment, the varnish is coated on the superconducting wire 2 after it is wound to form the flat coil. However, a superconducting wire 2 in which a bundle of filaments 2*b* impregnated with the thermoset varnish beforehand is helically wound on the rectangular wire 2*a* so that a space exists between the adjacent windings may also be used to form a flat coil.

A second embodiment of the present invention will be described below with reference to FIGS. 8A to 8C and 9. In this embodiment, a superconducting wire having a length corresponding to the two layers is wound from the center thereof in two directions to form a flat coil corresponding to two layers. Such two-layer flat coils are laid on top of another to form a superconducting coil.

A method of manufacturing superconducting coils according to the second embodiment of the present invention will be described. In this embodiment, a superconducting wire whose bundle of filaments is impregnated with the thermoset varnish beforehand is used. The superconducting wire 2 having a length corresponding to two layers is divided into two portions, and one portion of the wire is wound from a substantially intermediate portion of the wire outwardly and in a right-handed fashion a plurality of times to form a first layer flat coil (step S20). Next, the formed flat coil is pressed by a pressing machine (not shown) to shape it and then heated to set the varnish and thereby bond the superconducting wires 2 to each other (step S21).

Next, the adhesive sheet 9 shown in FIG. 3 is placed on a portion of the first layer flat coil except for the two coil end portions 6*c* thereof (see FIG. 8A) (step S22). The peripheral unnecessary portion of the adhesive sheet is cut off later.

Figure 8A:
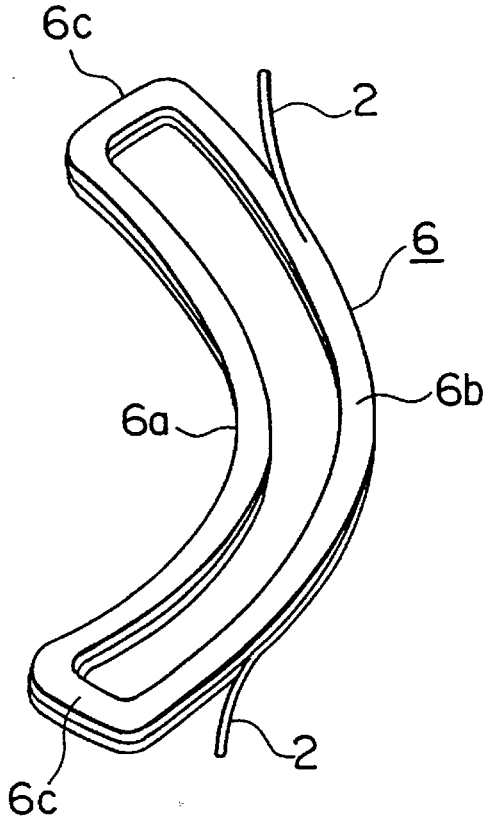
FIGS. 8A to 8C are perspective views sequentially illustrating the manufacturing processes of a method of manufacturing a superconducting coil according to a second embodiment of the present invention.

Next, the other portion of the superconducting wire 2 is wound from the intermediate portion of the wire in a left-handed fashion and outwardly a predetermined number of times in such a manner that the adhesive sheet 9 is interposed between the first and second layer flat coils to form a second layer flat coil (step S23). Next, the first and second layer flat coils are pressed by a press in a state where they are laid on top of the other so as to shape the two-layer flat coil, and then heated to fix the superconducting wires 2 of the second layer flat coil to each other and at the same time to adhere the first and second layer flat coils to each other. Thus, two-layer flat coil 6 shown in FIG. 8A is formed (step S24). This two-layer flat coil 6 has a two-layer inner diameter portion 6*a*, a two-layer outer diameter portion 6*b* and two-layer coil end portions 6*c*.

Figure 8B:
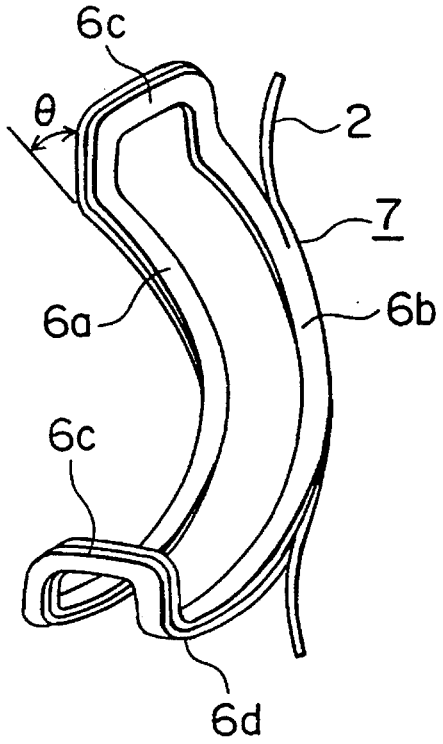

Next, both of two-layer coil end portions 6*c* are bent by a bending machine (not shown) relative to the plane in which the two-layer inner and outer diameter portions 6*a* and 6*b* are present, as shown in FIG. 8B. Consequently, the two-layer coil end portions 6*c* are raised at a predetermined angle θ in the direction in which they are separated from the path 20 (see FIG. 12) such that they oppose each other (step S25). Next, the adhesive sheet 9 is inserted between the first and second layer coil end portions 6*c* and heated to bond the coil end portions, by means a two-layer coil unit (a two-layer pancake unit) 7, thus forming the first stage is completed (step S26).

Next, the flow returns to step S20 and a two-layer coil unit 7 which constitutes the second stage is formed by executing the processes from steps S20 to S26. When the two-layer coil unit which constitutes the second stage is formed, both of the two-layer coil end portions 6*c* are bent in step S25 such that they can exactly be registered with the coil end portions 6*c* of the coil unit of the first stage when the second stage is laid on top of the first stage. To achieve this, the flat coil has a longer longitudinal length than that laid on the inner, i.e., upper side thereof.

The precesses from step S20 to step S26 are repeated until two-layer coil units composing a predetermined number of stages (for example, N/2 stages) are completed (step S27).

When the two-layer coil units 7 of the predetermined number of stages are formed, these coil units 7 are laid on top of another in a predetermined order. At that time, the adhesive sheet 9 shown in FIG. 3 is interposed between the adjacent coil units 7 (step S28). The peripheral unnecessary portion of the adhesive sheet 9 is cut off later.

Figure 10:
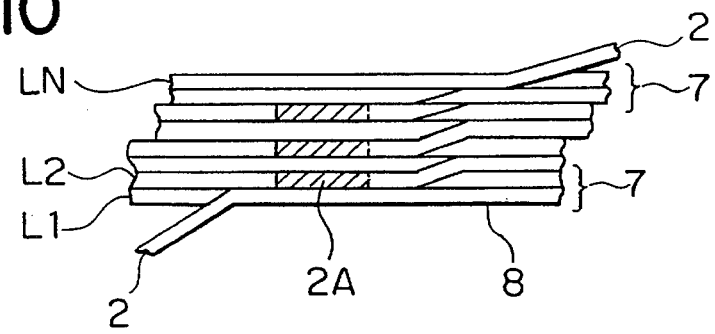
FIG. 10 is a side elevational view of connecting portions as viewed from a direction indicated by an arrow X of FIG. 8C.

Next, the ends of the superconducting wires 2 located on the outer side of the two-layer outer diameter portions 6*b* of the adjacent two-layer coil units 7 are electrically connected to each other to electrically connect the coil units 7 which are laid in series (step S29). FIG. 10 shows connecting portions 2A located on the outer side of the outer diameter portions, as viewed from the direction indicated by an arrow X of FIG. 8C which shows a completed superconducting coil 8. Each of the connecting portions 2A exists on the second layer of each of the two-layer coil units 7. At the connecting portion 2A, the ends of the superconducting wires 2 are connected with each other by pressing, soldering or melting. The adhesive sheets (see FIG. 3) interposed between the adjacent coil units 7 are omitted in FIG. 10.

Figure 8C:
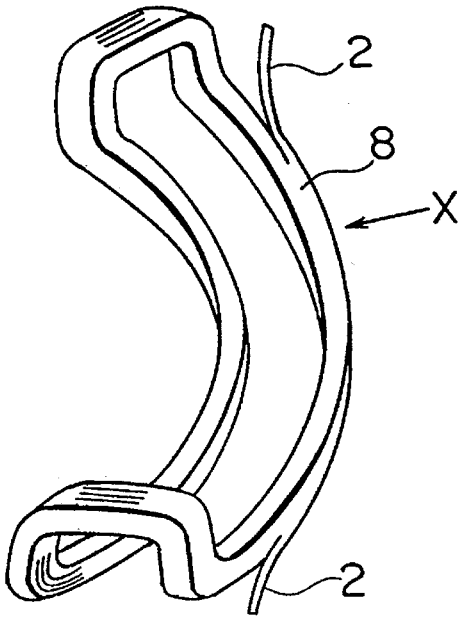
Figure 9:
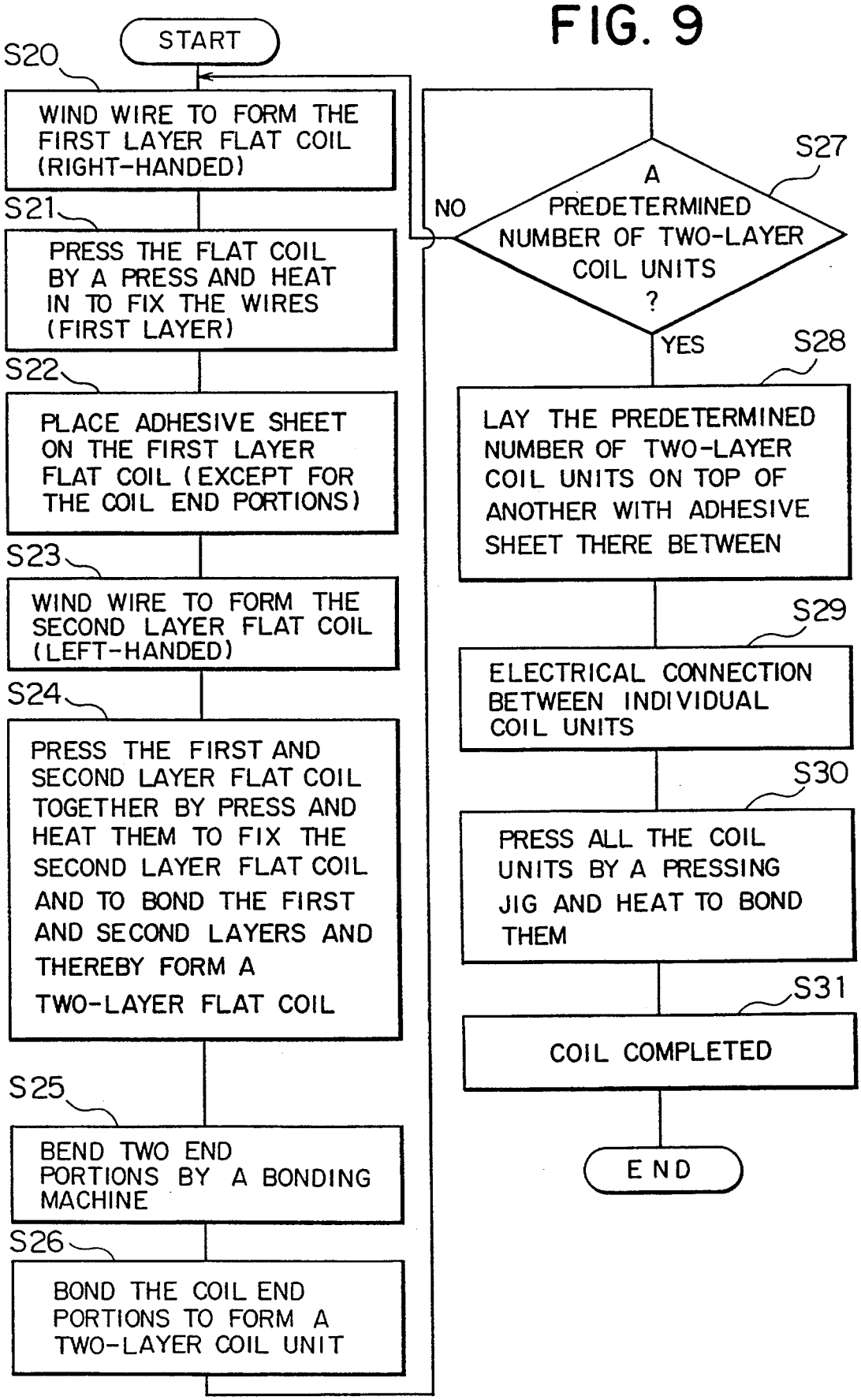
FIG. 9 is a flowchart of the embodiment shown in FIGS. 8A to 8C.

The two-layer coil units 7 which are laid on top of another are pressed by a pressing jig (not shown) to shape them, and then heated to bond the individual coil units 7 with each other, by which a superconducting coil 8 shown in FIG. 8C is manufactured (steps S30 and S31). The cross-sectional views of the superconducting coil 8 are substantially the same as those shown in FIGS. 5A and 5B, illustration being omitted.

In this embodiment, since the two-layer flat coil 6 is formed by winding a single superconducting wire having a length corresponding to the two layers, the number of connecting portions 2A of the superconducting wire 2 can be reduced as compared with the first embodiment. Also, since all the connecting portions can be placed on the outer side of the outer diameter portions which exhibit a low magnetic flux density, the connecting portions can be less influenced by the magnetic field generated by the superconducting coil 8.

Furthermore, since the coil end portions of the first and second layers of the two-layer coil unit 7 are bonded with each other after the bending, it is possible to reduce mechanical distortion of the superconducting wires 2 at bending portions 6*d* and the coil end portions 6*c* (see FIG. 8B). This prevents deterioration of the superconducting wire 2 and improves dimension accuracy after the bending.

In the embodiment shown in FIGS. 8A to 8C, the connecting portions 2A between the individual stages exist on the outer side of the outer diameter portion of the superconducting coil which exhibits a relatively low magnetic flux density. Another embodiment in which the connecting portions are provided at locations exhibiting lower magnetic flux density will now be described with reference to FIGS. 11A to 11C.

Figure 11A:
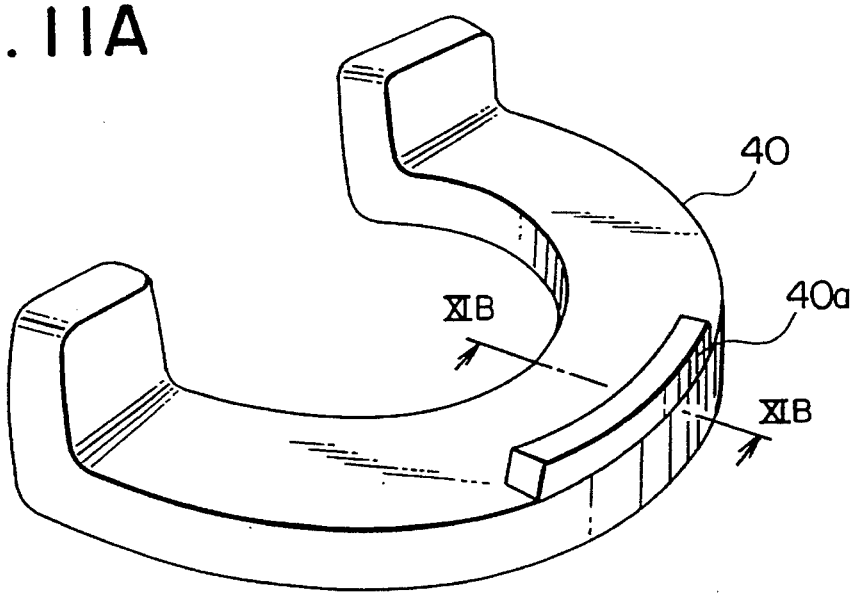
FIG. 11A is a perspective view illustrating a coil container in which a superconducting coil is housed according to a third embodiment of the present invention.
Figure 11B:
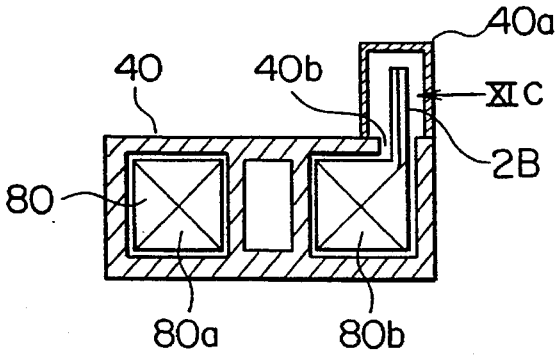
FIG. 11B is a section taken along a line XIB—XIB of FIG. 11A.
Figure 11C:
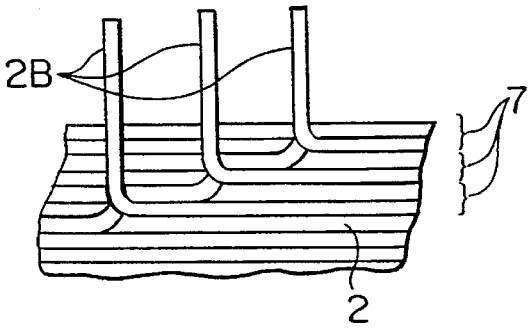
FIG. 11C is a side elevational view of connecting portions of a superconducting coil as viewed from a direction indicated by an arrow XIC of FIG. 11B.

FIG. 11A is a perspective view of a coil container in which a superconducting coil is housed, FIG. 11B is a section taken along a line XIB—XIB of FIG. 11A, and FIG. 11C is a side elevational view of a superconducting coil as viewed from the direction indicated by an arrow XIC of FIG. 11B.

In this embodiment, a superconducting coil 80 is formed by laying the two-layer coil units 7 shown in FIG. 8B on top of another, and the superconducting coil 80 is housed in a coil container 40 charged with a coolant (not shown). The superconducting coil 80 has an inner diameter portion 80*a*, an outer diameter portion 80*b*, and coil end portions (not shown) located at the two sides of coil. The two ends of each superconducting wire 2 of each two-layer coil unit 7 exist on the outer side of the outer diameter portion 80*b* of the superconducting coil 80. The two ends of the superconducting wire 2 of each two-layer coil unit 7 are electrically connected to the two ends of the superconducting wires 2 of the adjacent two-layer coil units 7 at connecting portions 2B to series-connect the individual coil units 7 which are laid. The two ends of the superconducting wire 2 of each unit 7 are extended in an upward direction such that they are separated from the superconducting coil 80, and the connecting portion 2B is provided at a position which exhibits a low magnetic flux density. The connecting portions 2B exist within a connecting portion cover 40*a* formed above the container 40 and communicating with the container 40 through an opening 40*b*. The interior of the connecting portion cover 40A can also be maintained to a very low temperature by a coolant.

Thus, the connecting portions 2B of the superconducting wires 2 of the individual coil units exist at a position which exhibits a low magnetic flux density. Consequently, the electromagnetic force applied to the connecting portions 2B can be reduced, and reliability of the connecting portions 2B can thus be improved. Furthermore, critical current of the connecting portion (the upper limit of the current that can flow through the connecting portion which exhibits superconductivity) can be increased.

As in the case of the aforementioned embodiments, connection of the connecting portion 2B may be conducted in the third embodiment by pressing, soldering or melting. Alternately, the superconducting filaments 2*c* provided within the superconducting wire 2 shown in FIG. 7B may be exposed so that the exposed thin superconducting filaments 2*c* can be connected by pressing or melting. This connection is called superconducting connection. When the superconducting connection is performed, a test must be made to check whether or not a reliable superconducting connection is achieved. The test can be readily conducted when the connecting portions 2B are extended from the superconducting coil 80, as in the case of the third embodiment.

In the aforementioned embodiments, the coil units 4 or the two-layer coil units 7 are laid on top of another and series-connected to each other. However, the coil units 4 or 7 which are laid may be parallel-connected, connected in series-parallel combinations or connected in series, parallel and series-parallel combinations.

Furthermore, the superconducting wire 2 is used in the aforementioned embodiments. However, a normally conducting wire may also be used. That is, the present invention can also be applied to a normally conducting coil. Furthermore, there is no limitation to the cross-sectional form of a conducting wire.

Furthermore, in the aforementioned embodiments, the superconducting coil which is the main coil for generating a magnetic field of several teslas on the beam path 20 has been described as the coil for use in a charged particle deflecting electromagnet. However, the present invention can also be applied to a correcting coil for correcting the magnetic field generated by the main coil or to an auxiliary coil for reinforcing the intensity of magnetic field generated by the main coil.

As will be understood from the foregoing description, the coil for the charged particle deflecting electromagnet according to the present invention is formed by laying a predetermined number of coil units on top of another, each coil unit being formed by bending the coil end portions of a flat coil, and then by electrically connecting the laid coil units. Consequently, a complicated winding operation of the conducting wire can be eliminated as well as a device therefor. This leads to reduction in production cost of the coil. Furthermore, since all the conducting wires are wound outwardly, the possibility that a gap be generated between the coils can be reduced, and a highly reliable coil can thus be offered.

What is claimed is:

1. A method of manufacturing coils for use in charged particle deflecting electromagnets, said method comprising the steps of:

forming a plurality of flat coils including forming a plurality of right-handed flat coils and a plurality of left-handed flat coils, each of the right and left-handed flat coils being formed by winding a conducting wire outwardly from a reference point and fixedly adhering the conducting wires to each other, each flat coil including an inner diameter portion disposed on an inner diameter side of an arcuate path of charged particles, an outer diameter portion disposed on an outer diameter side of said path, and coil end portions located at two sides of said inner an outer diameter portions for connecting said inner an outer diameter portions with each other;

forming coil units by bending the two coil end portions of each of said flat coils in a direction opposite to said path such that they oppose each other:

stacking a predetermined number of coil units;

adhering the stacked coil units to one another; and electrically connecting the stacked coil units.

2. A method of manufacturing coils for use in charged particles deflecting electromagnets, each of said coils being formed by stacking a plurality of two-layer coil units, each of the two-layer coil units being formed by winding a conducting wire having a length corresponding to two layers such that two ends of the conducting wire having a length corresponding to two layers such that two ends of the conducting wire are located on an outer peripheral portion of the coil unit, said method comprising:

forming the plurality of two-layer flat coils each of which has an inner diameter portion disposed on an inner diameter side of an arcuate path of charged particles, an outer diameter portion disposed on an outer diameter side of said path, and coil end portions located at two sides of said inner and outer diameter portions for connecting said inner and outer diameter portions with each other, said step of forming the two-layer flat coil including steps of forming a first layer flat coil by winding half of a single conducting wire having a length corresponding to the two layers from an intermediate portion of the wire outwardly from a reference point in one direction, and forming a second layer flat coil by winding the remaining portion of the conducting wire from the intermediate portion of the wire outwardly from the reference point in the other direction, said two steps of forming the first and second layer flat coils being repeated to form the plurality of the two-layer flat coils;

forming two-layer coil units by bending the coil end portions of each of the two-layer flat coils in a direction opposite to said path such that they oppose each other;

laying the plurality of two-layer coil units on top of another in a predetermined order; and electrically connecting ends of the conducting wires of the two-layer coil units which are laid with each other.

3. A method of manufacturing coils for use in charged particle deflecting electromagnets according to claim 2 wherein said step of forming the two-layer flat coil further includes a step of fixing the first layer flat coil by adhering the conducting wires of the first layer flat coil with each other, a step of fixing the second layer flat coil by adhering the conducting wires of the second layer flat coil, and a third step of adhering the first and second layer flat coils with each other with an adhesive member interposed therebetween, wherein said manufacturing method further comprising a step of forming the two-layer coil units which are laid as one unit by adhering the two-layer coil units which are laid by an adhesive member which is interposed between the adjacent two-layer coil units.

4. A method of manufacturing coils for use in charged particles deflecting electromagnets according to claim 3 wherein in said third step in said step of forming the plurality of two-layer flat coils, said adhesive member is interposed between the inner and outer diameter portions of the first and second layer flat coils to bond the inner and outer diameter portions, said coil end portions being adhered after the bending step.

5. A method of manufacturing coils for use in charged particles deflecting electromagnets according to claim 2 wherein said conducting wire comprises a superconducting wire.

* * * * *